United States Patent [19]

Gotman

[11] Patent Number: 4,869,139

[45] Date of Patent: Sep. 26, 1989

[54] ROTATING DRIVER WITH AUTOMATIC SPEED AND TORQUE SWITCHING

[75] Inventor: Alexander S. Gotman, 1960 Linda Flora Dr., Los Angeles, Calif. 90077

[73] Assignees: Alexander S. Gotman; Gene W. Arant; Marvin H. Kleinberg; Marshall A. Lerner, Santa Paul, Calif.

[21] Appl. No.: 64,182

[22] Filed: Jun. 19, 1987

[51] Int. Cl.[4] ..... B25B 23/157; B25B 21/00

[52] U.S. Cl. ..... 81/475; 81/467; 81/57.14; 74/751

[58] Field of Search ..... 81/467, 473–476, 81/54, 57, 57.11, 57.14, 57.22, 57.3, 57.31; 74/751, 768; 173/12, 163

[56] References Cited

U.S. PATENT DOCUMENTS

| | | | |
|---|---|---|---|
| 3,018,673 | 1/1962 | Hitt et al. | 74/751 X |
| 3,739,659 | 6/1973 | Workman, Jr. | 81/57.14 |

FOREIGN PATENT DOCUMENTS

| | | | |
|---|---|---|---|
| 610490 | 12/1960 | Canada | 81/57.11 |
| 1150630 | 6/1963 | Fed. Rep. of Germany | 81/57.11 |
| 2336477 | 2/1975 | Fed. Rep. of Germany | 81/474 |

OTHER PUBLICATIONS

"Operator's Manual" The Aro Corporation, Section M40–Manual 42–Revised 1/82–Form: 160–2.

"Torrington Bearings" Catalog 586, 1980.

*Primary Examiner*—Debra Meislin

*Attorney, Agent, or Firm*—Gene W. Arant; Don C. Lawrence

[57] ABSTRACT

A driver with automatic speed and torque switching including two different drive trains which operate in parallel and are driven at the same time by a motor. One drive train provides a high-speed output while the other provides a low-speed output. A single drive head for transmitting torque to the nut is normally coupled to the high-speed output, and not to the low-speed output. The machine operates initially at the high speed for the "free rotation" of the nut. When the nut contacts the surface of the structural body, the drive coupling to the high-speed output is disabled, and the low-speed output (which formerly was not coupled to the drive head) is not at the same time coupled to the drive head. The nut is then driven much more slowly but with a higher driving torque. Within the low-speed drive train there is included a friction clutch, and adjustment means for adjusting the level of torque at which it will slip. This clutch is therefore set for the predetermined counter-torque that is to cause driving rotation to be terminated.

8 Claims, 2 Drawing Sheets

ROTATING DRIVER WITH AUTOMATIC SPEED AND TORQUE SWITCHING

BACKGROUND OF THE INVENTION

In the manufacture of frames for aircraft and space vehicles there are very heavy demands placed upon fastening systems. The relatively simple task of securing a nut upon the end of the bolt must be accomplished thousands of times. The consequences of inefficiency in the manufacturing process are significant, and anything less than optimum performance of the completed structure can have disastrous effects.

When the nut is placed upon the extreme threaded end of the bolt it is first necessary to properly engage the threads of the nut with the threads on the bolt. Then the nut can be rotated quite rapidly for some number of revolutions because it is in "free" rotation—that is, its rotation is opposed only by the friction between the two sets of threads. This friction produces only a rather low level of counter-torque.

The next occurrence is that the nut comes into contact with the surface of the aircraft frame or other body to which the fastening system is being applied. As soon as this happens the counter-torque increases rapidly, because the end face of the nut is now in frictional contact with that surface. After the initial contact, when the nut is tightened even a portion of a revolution, since the effective length of the bolt is being reduced, an axial stress is developed. This axial stress increases continuously as the nut is being tightened. The greater this stress the greater is the friction counter-torque created at the end face of the bolt in contact with the surface of the body.

A problem that has occurred in the past is that the nut is rotated rapidly during the "free rotation" step, the nut and its driving tool acquire a great deal of inertia, and the result is that upon impact with the surface of the body some structural damage is caused. This structural damage may be to the threads of the bolt or the threads of the nut but is not necessarily thus limited. Therefore, careful control of the "free" rotation impact is extremely desirable.

One present method of assembly has been to perform the entire operation with a hand tool. The "free" rotation is then adequately controlled but the process is slow and is expensive in terms of labor.

Another present method has been to use a power tool that is capable not only of driving the nut during its "free" rotation, but also of tightening the nut after contact with the surface of the structural body is achieved. This approach is inefficient and is likely to cause structural damage.

Another requirement of the installation procedure is that the nut be tightened to an extent which will produce exactly the axial tension inside the bolt that the design specifies. An established method of controlling the axial tension inside the bolt is to tighten the nut only to the point where the counter-torque or reaction torque reaches a predetermined value. That predetermined value is for the most part calculated but is also in part based upon laboratory tests.

There are at present two established methods for stopping the tightening of the nut at the predetermined level of counter-torque. One method is to build a thin-walled wrench socket on the rearward end of the nut, with the thin wall being so designed that it will shear off when the predetermined torque level is reached. The other established method is to use a tool which will stop applying rotating force when the predetermined torque level is reached.

The industry has felt a need to find an instrument which will perform all three requirements—running the nut rapidly in "free" rotation with low inertia of the rotating parts; switching to lower speed and higher torque when contact is made with the surface of the structural body; and then discontinuing the application of rotating force when the desired level of torque has been reached.

SUMMARY OF THE INVENTION

It is therefore the principal object and purpose of the invention to provide an instrument which is capable of performing, correctly and in rapid succession, the three different functions that are needed for securing a nut upon the end of a bolt.

A further object of the invention is to provide novel mechanisms which may be utilized in a two-speed rotary drive apparatus.

According to the present invention two different drive trains are utilized which operate in parallel and are driven at the same time by the motor. One drive train provides a high-speed output while the other provides a low-speed output. A single drive head for transmitting torque to the nut is normally coupled to the high-speed output, and not to the low-speed output. The machine operates initially at the high speed for the "free rotation" of the nut.

When the nut contacts the surface of the structural body, the drive coupling to the high-speed output is disabled, and the low-speed output (which formerly was not coupled to the drive head) is now at the same time coupled to the drive head. The nut is then driven much more slowly but with a higher driving torque.

Within the low-speed drive train there is included a friction clutch, and adjustment means for adjusting the level of torque at which it will slip. This clutch is therefore set for the predetermined counter-torque that is to cause driving rotation to be terminated.

In one embodiment of the invention the switching from high-speed to low-speed drive requires an action by the operator. In the preferred embodiment, however, no action by the operator is required and the machine accomplishes the switching automatically.

In order to accomplish the desired function of the machine, a preferred feature of the invention is to arrange the two drive trains such that portions of them are essentially in concentric relation, one inside the other. At a location relatively near to the motor a first clutch mechanism is included in the high-speed drive train for disabling it at the proper time. At a location nearer to the drive head a second clutch is provided for coupling the low-speed drive train to the drive head. A third clutch is the friction clutch mentioned previously, which is included in the low-speed drive train to limit the maximum tightening action that is applied to the nut.

DRAWING SUMMARY

FIG. 1 is a longitudinal cross-sectional view of a complete machine in accordance with the present invention; and FIG. 2 is a longitudinal cross-sectional view of a modified form of the forward end of the machine, which provides a fully automatic switching action.

DETAILED DESCRIPTION

Figure 1:
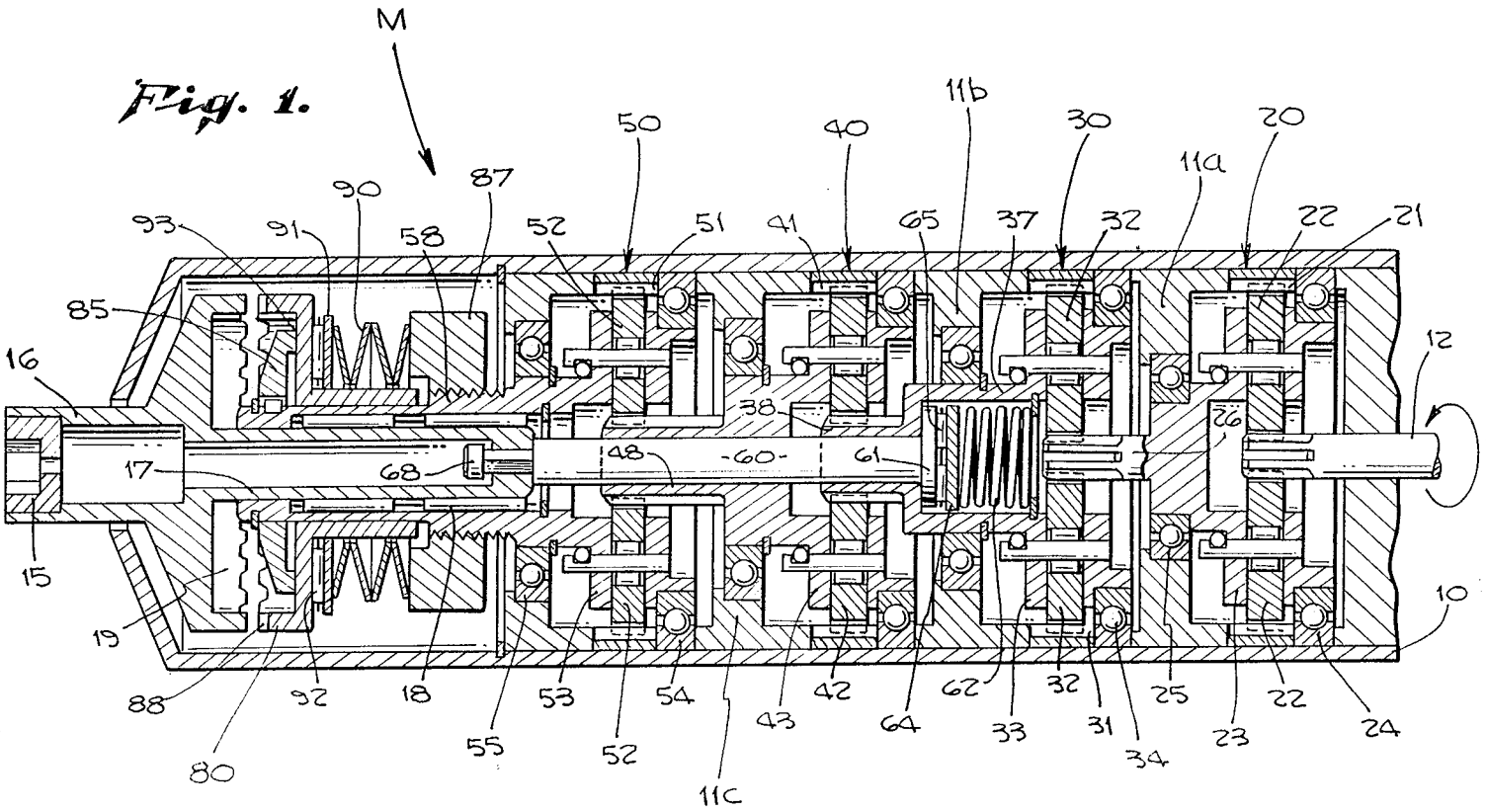

Reference is now made to FIG. 1 illustrating a first embodiment of the invention.

The machine M includes an elongated generally cylindrical housing 10. Input power is provided by a power input shaft 12 which may for example be driven from an air motor, not specifically shown. At the output end of the machine a drive head 15 is adapted to transmit torque to the nut that is to be driven.

The rotating speed of the power input shaft 12 may be typically about 18,000 rpm, while the desired output speeds are much lower. In driving the nut during its "free" rotation a speed of about 500 rpm is appropriate. After contact by the nut with the surface of the structural body (also not specifically shown) a rotating speed of about 5 to 15 rpm is more suitable. Corresponding changes are required in the driving torque applied to the drive head 15; that is, at the relatively high speed of 500 rpm a small amount of torque is needed, and at the much lower speed of 5 or 15 rpm a far higher driving torque is required.

In the example shown in FIG. 1 I use a series of four planetary gear systems to reduce the motor speed of about 18,000 rpm down to the much lower output speed of 5 or 15 rpm. The relatively high output speed of about 500 rpm is taken from the output of the second planetary gear system.

It is of course well known in the art to utilize a planetary gear system as a reduction gear. The system includes an internal, ring gear, a plurality of planetary, or satellite gears engaging the ring gear, a cage or carrier supported for rotation within the ring gear, with the planetary gears being supported from the cage for rotation relative thereto. A sun gear which is located concentric to the ring gear drivingly engages all the planetary gears. When the ring gear is held stationary the planetary gears and cage rotate within it, and the output speed of the cage is then reduced from the rotating speed of the sun gear. This is the manner in which planetary gear systems are utilized in the present invention.

In the present example the series of four planetary gear reduction stages are designated as 20, 30, 40, and 50. The high-speed output is taken from the second stage 30, while the low-speed output is taken from the fourth stage 50.

More specifically, first stage 20 includes a ring gear 21 which is affixed inside the housing 10. Planetary gears 22 are inside the ring gear and engage its teeth. They are supported on cage 23. Bearings 24 between cage 23 and housing 10 serve to center the cage and also provide it with a rotatable support. A bulkhead 11*a* inside the housing carries bearings 25 which rotatably support an output end portion of the cage 23 For the first stage 20, the sun gear is the toothed end of drive shaft 12.

Second stage 30 is similarly constructed and has similarly numbered parts, including a cage 33. Its sun gear is a toothed shaft 26 which protrudes from the output end of cage 23 of the first stage 20. The output end portion of cage 33 is uniquely formed, however; it includes a fairly large hollow cylindrical portion 37 which is followed by a smaller hollow cylindrical portion 38. The smaller cylindrical portion 38 has external teeth forming a sun gear for the planetary stage 40.

A high speed auxiliary output shaft 60 receives the output power from stage 30 for delivery to the drive head 15. Shaft 60 has a large flat circular head 61 which is retained within the large hollow cylinder 37 while the main body of the shaft extends through the smaller hollow cylinder 38 and then extends toward the output end of the machine. Also contained within the large cylinder 37 are a helical compression spring 62, a snap ring 63 securing the rearward end of the spring in place, a pressure plate 64 at the forward end of spring 62, and a needle thrust bearing 65 between pressure plate 64 and the shaft head 61. The mechanisms within the cylinder 37 together form a first friction clutch 66. Needle bearing 65 permits the shaft 60 to rotate without significant friction on the rearward side of the shaft head 61. The forward side of the shaft head, however, rubs upon a flat radially extending wall which constitutes the forward end wall of cylinder 37. The spring-loaded contact between shaft head 61 and the forward end wall of cylinder 37 provides sufficient friction for driving the nut during its "free" rotation at the relatively high speed.

It will be seen that drive head 15 is supported within the forward end of a specially constructed drive head housing 16. Housing 16 has a rearward extension 17 to which the forward end of shaft 6 is attached in non-rotating relation therewith, the two members being secured together against extensive longitudinal relative motion by a screw 68. Thus, driven rotation of the power input shaft 12 powered by a motor (not shown) experiences two stages of gear reduction in planetary gear stages 20 and 30, then the relatively high speed of about 500 rpm is applied through shaft 60 to drive head housing 16, 17 and drive head 15. During the "free" rotation of the nut there is no slippage of the friction clutch 66.

The hollow cylinder 38 which is externally toothed acts as the sun gear for third planetary stage 40, with the cage 33 of the second stage being effectively the input shaft for driving the third stage. Cage 43 of third stage 40 has an elongated central opening therethrough which permits the shaft 60 to extend through the cage 43 and to rotate relative thereto. Thus, portions of the power train driving the high-speed output (shaft 60) and of the power train driving the low-speed output (cage 43 of third planetary gear stage 40) are concentric to each other. Cage 43 has an elongated hollow forward end 48 which is externally toothed to act as an sun gear for the fourth stage.

Stage 50 includes a ring gear 51, planetary gears 52, a cage 53, and supporting bearings 54, 55. Cage 53 is hollow at its center to permit the passage therethrough of the shaft 60 in rotatable relation therewith. The forward extension of cage 53 is identified by numeral 58, and acts essentially as a low speed output shaft for driving the drive head 15, when the low-speed operation is taking place.

A bearing 18 is disposed between the cylindrical surface of cage portion (shaft) 58 and the rearward extension 17 of driver housing 16. This bearing supports and centers the driver housing and permits the drive head 15 to be driven at the relatively high speed (such as 500 rpm) even while the cage extension (shaft) 58 is rotating at the much lower speed (such as 5 or 15 rpm). The slow-speed rotation of shaft 58 continues at all times while the motor is running.

There are two separate clutch mechanisms associated with the low speed output shaft 58. One is a second toothed clutch 88, the purpose of which is to drive the drive head at the low speed (such as 5 or 15 rpm) when the high-speed drive has been de-coupled by allowing or causing the first friction clutch 66 to slip. The other is a third friction clutch 93, the purpose of which is to prevent excessive driving torque from being applied to the nut—and more specifically, to stop the driven rotation of the nut when the predetermined level of resistance torque has been reached (since, for structural design purposes, this level of resistance torque is assumed to indicate that the correct axial tensile stress has been applied to the bolt).

Driver housing 16 has integrally formed therewith a forward toothed clutch plate 19. A rear toothed clutch plate 80 is circumdisposed about the output shaft (cage extension) 58. The operation of the toothed clutch 88 will be explained in a later paragraph.

A retainer member 85 is placed on shaft 58 forwardly of the clutch 95 plate 80. Retainer member 85 is keyed to shaft 58 so as to rotate therewith. An adjusting nut 87 is carried on a threaded rear end portion of shaft 58. Just forwardly of the nut 87 are a series of Belleville springs 90. At the forward end of the Belleville springs there is a pressure plate 91, and a thrust needle bearing 92 is interposed between the pressure plate 91 and the rear face of rear clutch plate 80. The purpose of the Belleville springs, in conjunction with the adjusting nut 87, is to establish the predetermined level of driving torque at which the driven rotation of the nut will be terminated.

OPERATION OF FIRST EMBODIMENT

The operation of the first embodiment is as follows. Drive head 15 is placed in engagement with the nu (either directly or indirectly) and the motor (not shown) is turned on, thereby almost immediately causing the drive head to rotate at the speed of about 500 rpm. When the nut strikes the surface of the structural body the rotation of the drive head will stop, because the frictionally maintained driving torque through the high-speed power train is insufficient to overcome the resistance torque which is then encountered.

At this point the operator will observe two things—the nut is in contact with the body, and the rotation of the drive head has stopped. The operator then presses machine M towards the nut with a greater force. This causes driver housing 16 to slide rearwardly within hollow shaft 58, causing the forward toothed clutch plate 19 to engage the rearward toothed clutch plate 80, and at the same time causing the head 61 of shaft 60 to disengage from the forward wall of the chamber 37. The drive head and nut will then be driven at the relatively low speed of about 5 or 15 rpm.

As the nut is being tightened against the structural body, the counter-torque or resistance torque which it experiences will increase. This resistance torque is due to several factors including face-to-face contact between the nut and the body, and increasing axial tension within the bolt. When the nut is fully tightened the friction clutch member 85 will continue to rotate but the clutch member 80 will slip. The critical level of torque at which this action occurs will be determined by the previously established setting of the nut 87. Driven rotation of the nut then stops, and the operator disengages the machine.

PREFERRED EMBODIMENT

Figure 2:
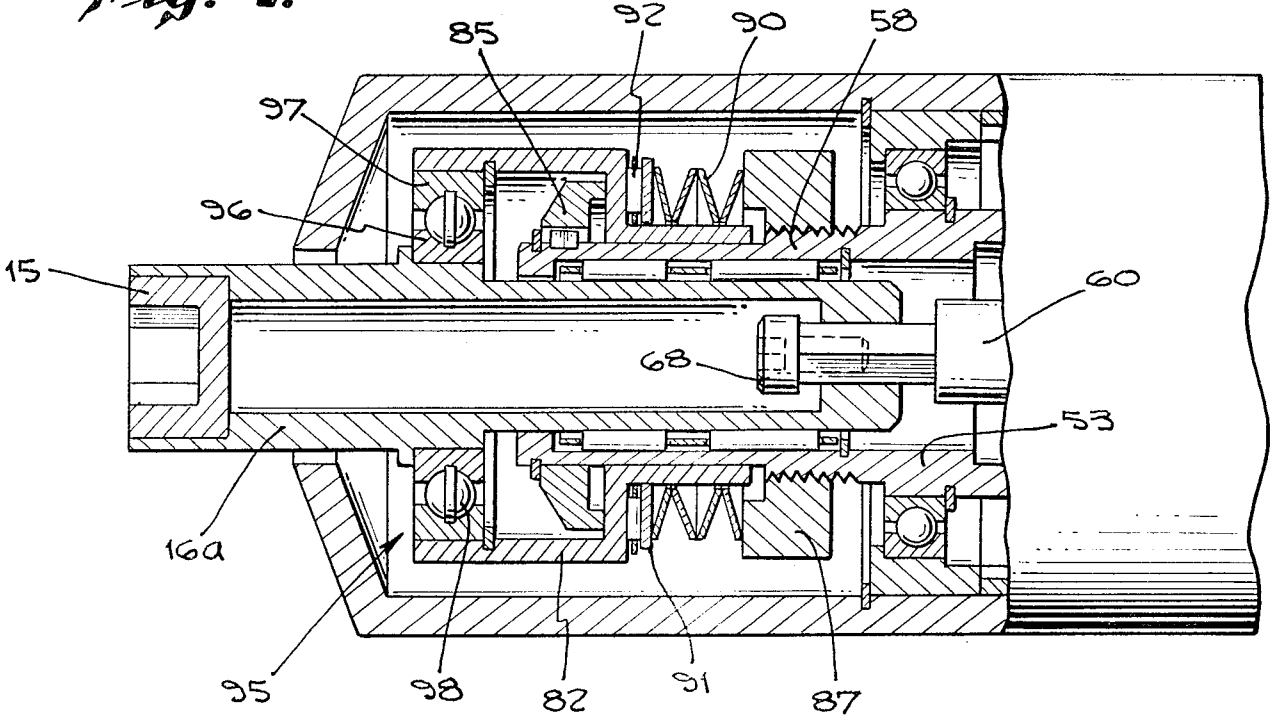

Reference is now made to FIG. 2 illustrating the preferred embodiment of the invention.

An overrunning one-way clutch 95 is substituted for the toothed clutch 88. Whereas the members 19 and 80 of the toothed clutch of FIG. 1 are plates which extend radially of the shaft 58 in axially spaced relation, in the preferred embodiment of FIG. 2 the clutch members are generally cylindrical members and are concentrically disposed relative to each other.

The over-running one-way clutch 95 includes an inner clutch member 96, an outer clutch member 97, and balls 98 which are positioned therebetween. Cams or ramps which are essential to the one-way clutch operation are also provided. Driver housing **16*a* directly supports the inner clutch member 96. Member 82 has a necked-down, cylindrical tube configuration with its forward extension being parallel to the axis of driver housing 16*a*. Outer clutch member 97 is supported inside the forward end of the member 82. Member 82 otherwise has the same shape and performs the same functions as member 80 of FIG. 1. Balls 98** together with the associated cams or ramps are disposed about the outer circumference of the inner clutch member and in contact with the inner circumference of the outer clutch member.

The structure and operation of an over-running one-way clutch are well known. In one direction of relative rotation between the two clutch members the balls and cams move freely, creating no significant opposition to the rotating movement. But in the other direction of relative rotation the cams or ramps associated with the balls create a wedging action which makes further rotation impossible.

In the present invention the operation of the one-way clutch is such as to permit the inner or high-speed shaft **60, 16*a* to rotate at the relatively high speed such as 500 rpm while the outer or low-speed shaft 53, 58, 82 rotates at the relatively low speed such as 5 or 15 rpm. The clutch 95** permits necessary overrunning or freewheeling between the clutch members to occur freely. But when driving force applied to the inner shaft is de-coupled or becomes insufficient, the outer shaft continuing to rotate at its same slow speed forces the inner shaft and drive head to rotate at the same speed.

OPERATION OF SECOND EMBODIMENT

In the operation of the second embodiment the steps are the same as for the first embodiment. The difference is that when the nut strikes the body and stops rotating, it cannot fully stop because the inner shaft will be compelled to continue rotating at the speed of the slow-speed shaft. The clutch plate 61 is not fully disengaged from the forward wall of the hollow cylinder 38 but slips as necessary to accommodate the lower driving speed of the nut.

The invention has been described in considerable detail in order to comply with the patent laws by providing a full public disclosure of at least one of its forms. However, such detailed description is not intended in any way to limit the broad features or principles of the invention, or the scope of patent monopoly to be granted, which is measured by the following claims.

What is claimed is:

1. An improved, two-speed, rotational drive apparatus of the type which includes a high-speed output shaft disposed concentrically within a hollow, low-speed output shaft, and a plurality of planetary gear systems, each having an internal gear, a sun gear, and at least one satellite gear, the gear systems being connected in series to form a speed-reducing train in which the sun gear of each of the systems except the first in the train is rotatably driven by the satellite gear of the immediately-preceding system at a reduced rate of angular speed relative to eh sun gear of the immediately-preceding system, and the low-speed output shaft is rotatably driven by the satellite gear of the last system in the train, wherein the improvement comprises:

the sun gear of the last system in the train having an opening through its center, the high-speed output shaft passing through said central opening and being connected to the sun gear of any one of the preceding gear systems, the sun gears of any systems intervening between the last system and said one system also having openings through their centers to permit the high-speed shaft to pass therethrough;

clutch means for selectably coupling one or the other of the two shafts to a rotatably driven element, whereby the ratio of the angular speed of the high-speed output shaft to that of the low-speed output shaft is larger than if the high-speed shaft were connected to the sun gear of the last gear system in the train.

2. The apparatus of claim 1 wherein said clutch means further comprises a first clutch for coupling the high-speed output shaft of the train to a rotatably driven element when the resistive torque in the element is less than a first, predetermined value, and for decoupling the high-speed shaft from the element when its resistive torque is greater than said first value; and a second clutch for coupling the low-speed output shaft of the train to the driven element when the high-speed shaft is decoupled from it, and for decoupling the low-speed shaft form the driven element when the high-speed shaft is coupled to it.

3. The apparatus of claim 2, wherein the second clutch further comprises:

on overrunning clutch for decoupling the low-speed shaft from the element when the rotational speed of the element is greater than the rotational speed of the low-speed shaft, and for coupling the low-speed shaft to the element when the element's rotational speed is less than said speed.

4. The apparatus of claim 3, further comprising:

a third clutch in series with the second clutch for coupling the low-speed output shaft to the driven element when the resistive torque in the element is less than a second, predetermined value, and for decoupling the low-speed shaft form the element when its resistive torque is greater than said second value.

5. In a two-speed rotational drive apparatus, the sub-combination of:

first and second planetary gear reduction stages, each stage comprising a fixed internal gear, a sun gear, and a satellite gear, each gear having a center, the sun gears and the satellite gears each being rotatable about their own respective centers, the centers of the satellite gears being rotatable about their own respective sun gears, the centers of the sun gears being disposed along a common, longitudinal drive axis passing through the centers of the internal gears, the sun gear of the second stage having a central opening therethrough, the center of the satellite gear of the first stage being connected to the sun gear of the second stage to drive it rotationally about its center in the same direction as, and at a reduced angular speed relative to, rotation of the sun gear of the first stage about its center;

a hollow, low-speed output shaft connected to the center of the satellite gear of the second stage and extending outwardly therefrom coaxially along the drive axis; and a high-speed output shaft connected to the sun gear of the first stage and extending outwardly therefrom coaxially along the drive axis and through the central opening of the sun gear of the second stage, the high-speed output shaft being disposed concentrically within the low-speed output shaft to rotate relative to it at a different rate of angular speed;

coupling means for selecting coupling one or the other of the output shafts to a rotatably driven element.

6. The apparatus of claim 5, wherein said coupling means further comprises:

a first clutch for coupling the high-speed output shaft of the train to a rotatably driven element when the resistive torque in the element is less than a first, predetermined value, and for decoupling the high-speed shaft from the element when its resistive torque is greater than said first value; and a second clutch for coupling the low-speed output shaft of the train to the driven element when the high-speed shaft is decoupled from it, and for decoupling the low-speed shaft from the driven element when the high-speed shaft is coupled to it.

7. The apparatus of claim 6, wherein the second clutch further comprises:

an overrunning clutch for decoupling the low-speed shaft from the element when the rotational speed of the element is greater than the rotational speed of the low-speed shaft, and for coupling the low-speed shaft to the element when the element's rotational speed is less than said speed.

8. The apparatus of claim 7, further comprising: a third clutch in series with the second clutch for coupling the low-speed output shaft to the driven element when the resistive torque in the element is less than a second, predetermined value, and for decoupling the low-speed shaft from the element when its resistive torque is greater than said second value.

* * * * *